US011385585B2

(12) United States Patent
Lee

(10) Patent No.: US 11,385,585 B2
(45) Date of Patent: Jul. 12, 2022

(54) DETERMINATION OF REMAINING LIFE OF PHOTOCONDUCTOR

(71) Applicant: Hewlett-Packard Development Company, L.P., Spring, TX (US)

(72) Inventor: Ki Youn Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/287,217

(22) PCT Filed: Oct. 22, 2019

(86) PCT No.: PCT/US2019/057415

§ 371 (c)(1),
(2) Date: Apr. 21, 2021

(87) PCT Pub. No.: WO2020/251612

PCT Pub. Date: Dec. 17, 2020

(65) Prior Publication Data

US 2021/0382428 A1 Dec. 9, 2021

(30) Foreign Application Priority Data

Jun. 13, 2019 (KR) ..... 10-2019-0070225

(51) Int. Cl.
*G03G 15/00* (2006.01)

(52) U.S. Cl.
CPC ..... *G03G 15/5033* (2013.01); *G03G 15/5016* (2013.01)

(58) Field of Classification Search
CPC ..... G03G 15/0266; G03G 15/5016; G03G 15/5033
See application file for complete search history.

(56) References Cited

U.S. PATENT DOCUMENTS

| | | | |
|---|---|---|---|
| 9,606,469 | B2 | 3/2017 | Izumi et al. |
| 2009/0008091 | A1 | 3/2009 | Kim et al. |
| 2010/0067943 | A1 | 3/2010 | Zogg et al. |
| 2016/0231664 | A1 | 8/2016 | Kubo |

FOREIGN PATENT DOCUMENTS

| | | | |
|---|---|---|---|
| JP | 2008-158075 | A | 7/2008 |
| JP | 2010-128012 | A | 6/2010 |
| JP | 4749137 | B2 | 8/2011 |
| JP | 2014-92698 | A | 5/2014 |
| JP | 5630708 | B2 | 11/2014 |

*Primary Examiner* — Hoang X Ngo
(74) *Attorney, Agent, or Firm* — Jefferson IP Law, LLP

(57) ABSTRACT

An example image forming apparatus includes a charger, a developing device, a sensor, and a controller. The charger may apply a plurality of charging voltages to a photoconductor, the plurality of charging voltages having different magnitudes and respectively corresponding to a plurality of area sections constituting a test pattern and the developing device may supply a developer to the photoconductor. The sensor may sense an image formed by the supplied developer and corresponding to the test pattern. The controller may determine a remaining lifetime of the photoconductor based on the image corresponding to the test pattern.

20 Claims, 9 Drawing Sheets

FIG. 7

| | REFERENCE CHARGING VOLTAGE | Vstep | TEST CHARGING VOLTAGES |
|---|---|---|---|
| $T_0$ | −1000V | 40V | −960V, −920V, −880V, −840V |
| $T_1$ | −1100V | 40V | −1060V, −1020V, −980V, −940V |
| $T_2$ | −1200V | 40V | −1160V, −1120V, −1080V, −1040V |
| $T_3$ | −1300V | 40V | −1260V, −1220V, −1180V, −1140V |
| $T_4$ | −1400V | 40V | −1360V, −1320V, −1280V, −1240V |

DETERMINATION OF REMAINING LIFE OF PHOTOCONDUCTOR

BACKGROUND

A photoconductor used in an image forming apparatus, such as a printer, a copier, a scanner, a facsimile, a multi-function device, or the like, is a consumable that may be replaced as needed, such as when its usage amount is reached. Replacing the photoconductor may be necessary because background defects may be caused by a photoconductor that has been worn, aged, damaged, or the like.

BRIEF DESCRIPTION OF THE DRAWINGS

FIG. 7 is a diagram showing charge voltages of different magnitudes applied to a photoconductor when a reference charging voltage changes over time according to an example;

DETAILED DESCRIPTION OF EXAMPLES

Figure 1:
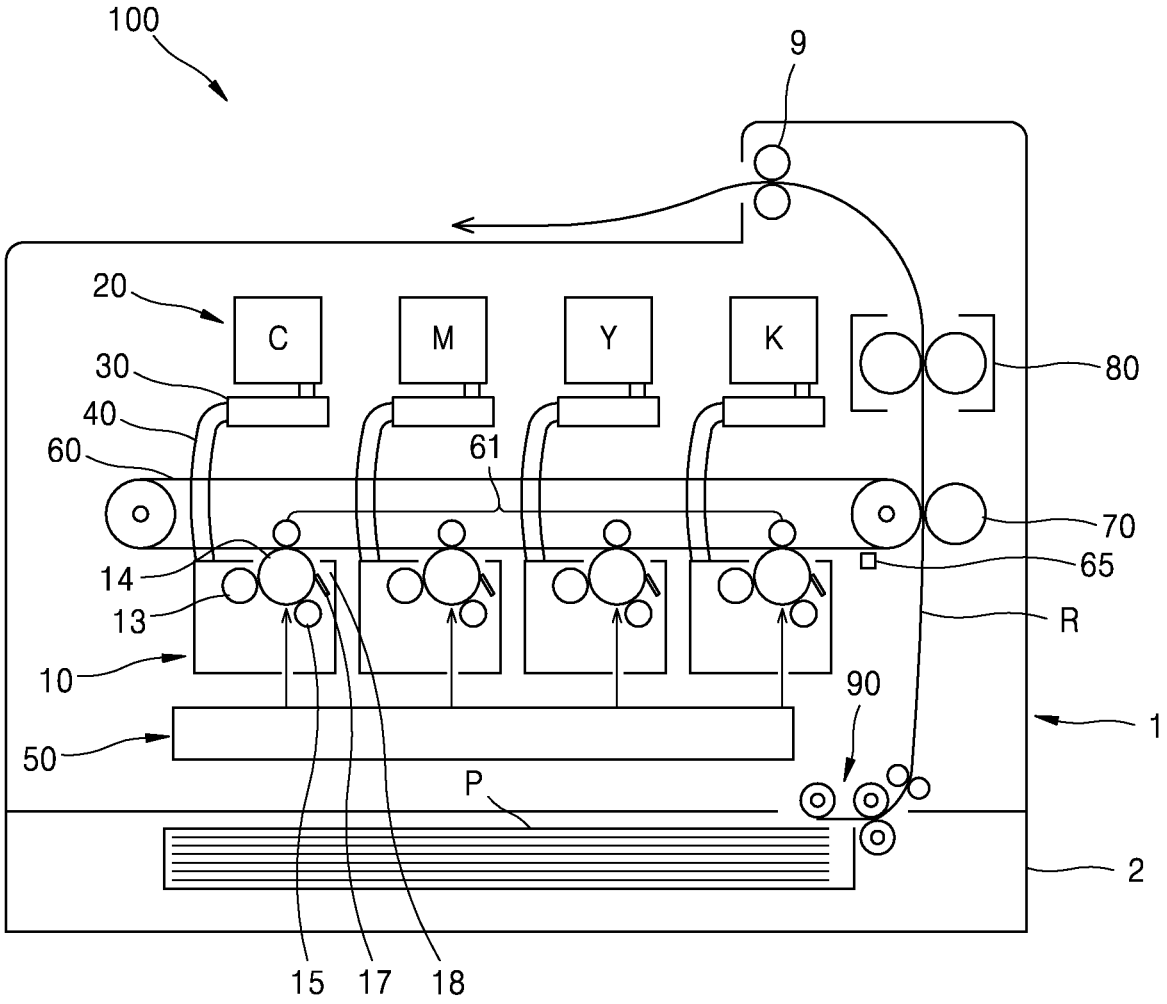
FIG. 1 illustrates a schematic structure and operation of an image forming apparatus according to an example.

Hereinafter, various examples will be described with reference to the drawings. Like reference numerals in the specification and the drawings denote like elements, and thus their descriptions will be omitted.

FIG. 1 illustrates a schematic structure and operation of an image forming apparatus according to an example.

Referring to FIG. 1, an image forming apparatus 100 may print a color image by using an electrophotographic developing method. The image forming apparatus 100 may include a plurality of developing devices 10, an exposure device 50, an intermediate transfer medium 60, a transfer roller 70, a fuser 80, and the like.

The image forming apparatus 100 may include the plurality of developing devices 10 and a plurality of developer cartridges 20 to contain developers therein. The plurality of developer cartridges 20 may be connected to the plurality of developing devices 10, respectively, and the developers accommodated in the plurality of developer cartridges 20 may be supplied to the plurality of developing devices 10, respectively. The plurality of developer cartridges 20 and the plurality of developing devices 10 may be detachable from a main body 1 and may be individually replaced.

The plurality of developing devices 10 may form a toner image of cyan C, magenta M, yellow Y, and black K colors. The plurality of developer cartridges 20 may respectively accommodate developers of the cyan C, magenta M, yellow Y, and black K colors, which are to be supplied to the plurality of developers 10. However, examples are not limited thereto, and the image forming apparatus 100 may further include the developer cartridge 20 and the developing device 10 for accommodating and developing a developer of various colors such as light magenta, white, etc. in addition to the above described colors.

The developing device 10 may include a photoconductor 14 having a surface on which a latent electrostatic image may be formed and a developing roller 13 to supply the developer to the electrostatic latent image to develop a visible toner image. A photoconductive drum, which is an example of the photoconductor 14 having the surface on which the latent electrostatic image may be formed, may include an organic photoconductor (OPC) including a conductive metal pipe and a photoconductive layer formed on an outer circumference of the conductive metal pipe.

A charger 15 may be a charging roller that charges the photoconductor 14 to have a uniform surface potential. The charger 15 may employ a charging brush, a corona charger, or the like instead of the charging roller.

The developing device 10 may further include a charging roller cleaner (not shown) to remove a foreign substance such as developer, dust, or the like adhered to the charger 15, a cleaning member 17 to remove the developer remaining on a surface of the photoconductor 14 after an intermediate transferring process, a regulating member (not shown) to regulate an amount of the developer supplied to a developing region where the photoconductor 14 and the developing roller 13 oppose each other, and the like. An amount of waste developer may be accommodated in a wasted developer accommodating portion 18.

The developer accommodated in the developer cartridge 20 may be supplied to the developing device 10. A developer supply unit 30 that receives the developer from the developer cartridge 20 may supply the developer to the developing device 10 and may be connected to the developing device 10 by a supply duct 40. The developer accommodated in the developer cartridge 20 may be toner. According to a developing method, the developer may include toner and a carrier. The developing roller 13 may be positioned apart from the photoconductor 14. A distance between an outer circumference surface of the developing roller 13 and an outer circumference surface of the photoconductor 14 may be, for example, several tens to several hundreds of microns. The developing roller 13 may include a magnetic roller. In the developing device 10, the toner may be mixed with the carrier, and the toner is attached to a surface of a magnetic carrier. The magnetic carrier may be attached to a surface of the developing roller 13 and conveyed to the developing region where the photoconductor 14 and the developing roller 13 oppose each other. Only the toner may be supplied to the photoconductor 14 by a developing bias voltage applied between the developing roller 13 and the photoconductor 14 such that the electrostatic latent image formed on the surface of the photoconductor 14 may be developed into a visible toner image.

The exposure device 50 may irradiate modulated light onto the photoconductor 14 in correspondence with image information to form the electrostatic latent image on the photoconductor 14. Representative examples of the exposure device 50 include a laser scanning unit (LSU) using a laser diode as a light source, a light emitting diode (LED) exposure device using an LED as the light source, or the like.

A transfer unit may transfer the toner image formed on the photoconductor 14 onto a print medium P, such as paper, and may include an intermediate transfer-type transfer unit. As an example, the transfer unit may include the intermediate transfer medium 60, an intermediate transfer roller 61, and the transfer roller 70.

An intermediate transfer belt, which is an example of the intermediate transfer medium 60 on which the toner image developed on the photoconductors 14 of the plurality of developing devices 10 may be transferred, may temporarily receive the toner image. The plurality of intermediate transfer rollers 61 may be disposed at positions respectively opposing the photoconductors 14 of the plurality of developing devices 10 with the intermediate transfer medium 60 therebetween. An intermediate transfer bias for intermediately transferring the toner image developed on the photoconductor 14 to the intermediate transfer medium 60 may be applied to the plurality of intermediate transfer rollers 61.

The transfer roller 70 may be positioned to oppose the intermediate transfer medium 60. A transfer bias for transferring the toner image transferred to the intermediate transfer medium 60 to the print medium P may be applied to the transfer roller 70.

The fuser 80 may apply heat and/or pressure to the toner image transferred to the print medium P to fix the toner image on the print medium P. A shape of the fuser 80 is not limited to the example shown in FIG. 1.

According to an example, the exposure device 50 may scan modulated light corresponding to image information of each color to the photoconductor 14 of the plurality of developing devices 10 to form the electrostatic latent image on the photoconductor 14. The electrostatic latent image of the photoconductor 14 of the plurality of developing devices 10 may be developed into the visible toner image by the C, M, Y, K developer supplied from the plurality of developer cartridges 20 to the plurality of developing devices 10. The developed toner images may be intermediately transferred to the intermediate transfer medium 60 sequentially. The print medium P loaded on a print medium feeding apparatus 2 may be transported along a print medium feeding path R by a print medium transporting apparatus 90 and transported between the transfer roller 70 and the intermediate transfer medium 60. The toner image intermediately transferred onto the intermediate transfer medium 60 may be transferred to the print medium P by the transfer bias voltage applied to the transfer roller 70. When the print medium P passes the fuser 80, the toner image is fixed to the print medium P by heat and pressure. The print medium P on which fixing is completed may be discharged by a discharge roller 9.

Figure 2:
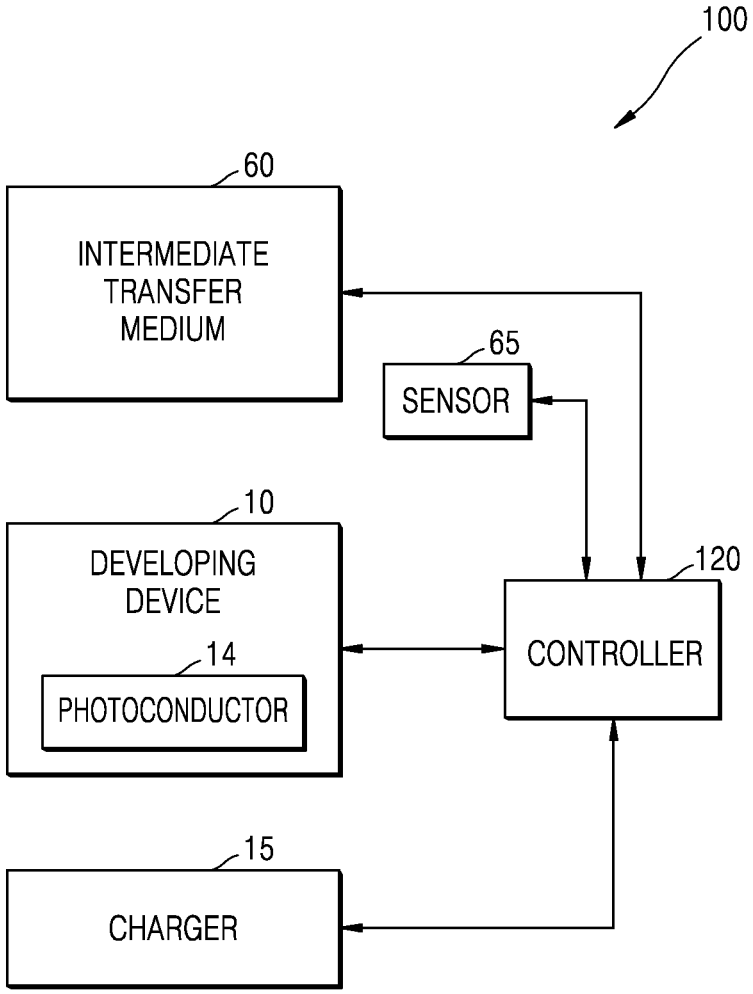
FIG. 2 is a block diagram of an image forming apparatus according to an example.

FIG. 2 is a block diagram of an image forming apparatus according to an example.

Referring to FIG. 2, the image forming apparatus 100 may include the charger 15, the developing device 10, the intermediate transfer medium 60, a sensor 65, and a controller 120. The image forming apparatus 100 may estimate a replacement time of the photoconductor 14 in order to improve user convenience and to reduce the replacement cost of consumables. The image forming apparatus 100 may form an image corresponding to a test pattern by using charge voltages of different magnitudes and estimate a remaining lifetime and a replacement time of the photoconductor 14 based on the image. To this end, the image forming apparatus 100 may perform the following operations.

The charger 15 may vary a charging voltage applied to the photoconductor 14. The charger 15 may receive voltages of different magnitudes from a power supply source (not shown). The charger 15 may apply a plurality of charging voltages to the photoconductor 14, the plurality of charging voltages having different magnitudes and respectively corresponding to a plurality of area sections constituting the test pattern. The charger 15 may apply charging voltages to the photoconductor 14 of different magnitudes that are in an equally increasing relationship from a reference charging voltage set for a normal printing operation. The charger 15 may change and apply the charging voltage to the photoconductor 14 based on a certain time interval or based on a rotation of the photoconductor 14 by a predetermined angle. The charger 15 may apply the charging voltage to the photoconductor 14 to form a potential on a surface of the photoconductor 14.

In an example, the exposure device 50 may not operate when the image forming apparatus 100 forms an image corresponding to a test pattern. When an exposure process is not performed on the photoconductor 14, the photoconductor 14 may not form an image even though a developer is supplied. However, because a surface potential of the photoconductor 14 may not be sufficiently maintained by the charging voltage, for example if the photoconductor is subject to replacement due to a reduction in a thickness of a coating film of the photoconductor 14, the developer may move to an area of the photoconductor 14 that does not perform the exposure process. As a result, a background defect may occur in which the developer is smeared or otherwise located in a non-image area that is not exposed.

The developing device 10 may supply developer to the photoconductor 14 to form an image corresponding to the test pattern on the photoconductor 14. The developing device 10 may supply developer to the photoconductor 14 that does not perform the exposure process (i.e., to the photoconductor 14 that has not been exposed by the exposure device 50).

When the charger 15 applies a charging voltage to the photoconductor 14 that is higher than a reference charging voltage used for the normal printing operation and the surface potential of the photoconductor 14 is not sufficiently maintained, a background defect in the non-image area that is not exposed may occur. In an example, the higher the charging voltage, the higher the probability that the background defect may occur. When the charger 15 applies the plurality of charging voltages of different magnitudes to the plurality of respective area sections constituting the test pattern, the background defect may occur in some area sections of the image corresponding to the test pattern according to an actual usage amount of the photoconductor 14.

The image corresponding to the test pattern may be transferred to the photoconductor 14 or the intermediate transfer medium 60 before being transferred to the intermediate transfer medium 60 and then formed on the intermediate transfer medium 60. Therefore, the sensor 65 may sense the image corresponding to the test pattern formed on the photoconductor 14 or formed on the intermediate transfer medium 60. Hereinafter, for convenience of description, an example will be described in which the sensor 65 senses the image corresponding to the test pattern formed on the intermediate transfer medium 60. However, this is not to be construed as limiting.

The image corresponding to the test pattern formed on the photoconductor 14 may be transferred to the intermediate transfer medium 60. The sensor 65 may sense the image corresponding to the test pattern transferred onto the intermediate transfer medium 60. The sensor 65 may include a photosensor. The number of sensors 65 may be one or more than one. The sensor 65 may be positioned to face one side of the intermediate transfer medium 60 so as to correspond to a main scanning direction of the intermediate transfer medium 60. When there are a plurality of sensors 65, each sensor 65 may partially sense the image corresponding to the test pattern formed on the main scanning direction of the intermediate transfer medium 60. In an example, the image corresponding to the test pattern may be formed on the same line in the main scanning direction of the intermediate transfer medium 60.

The controller 120 may control an operation of the image forming apparatus 100 and may include at least one processor such as a central processing unit (CPU) or the like. The controller 120 may control other components included in the image forming apparatus 100.

The controller 120 may determine the remaining lifetime of the photoconductor 14 based on images corresponding to test patterns obtained over time. As described above, the charger 15 may vary a magnitude of the charging voltage, thereby creating various conditions under which the background defect is more likely to occur than an actual printing condition. In order to determine the remaining lifetime of the photoconductor 14, the controller 120 may confirm the conditions under which the background defect occurs over time and estimate a time at which the background defect may occur under the same conditions as the actual printing condition.

For example, the controller 120 may store in a memory (not shown) a charging voltage value corresponding to an area section where the background defect occurs in the image corresponding to the test pattern, the reference charging voltage value set for the normal printing operation, usage amount information of the photoconductor 14, and usage period information for every predetermined period. The controller 120 may estimate the remaining lifetime of the photoconductor 14 according to a trend analysis based on the information stored in the memory (not shown). As another example, the controller 120 may transmit to a printing service management server the charging voltage value corresponding to the area section where the background defect occurs in the image corresponding to the test pattern, the reference charging voltage value set for the normal printing operation, the usage amount information of the photoconductor 14, and the usage period information for every predetermined period through a communication interface device (not shown). The controller 120 may receive the remaining lifetime of the photoconductor 14, estimated based on the trend analysis based on the transmitted information from the printing service management server through the communication interface device (not shown).

In an example, the image forming apparatus 100 may display information about an image forming job or information about a status of the image forming apparatus 100 or receive a user input from a user through a user interface device (not shown). The user interface device (not shown) may include a touch screen. The controller 120 may display a result of the determination of the remaining lifetime of the photoconductor 14 through the user interface device (not shown).

The image forming apparatus 100 may be connected to an external apparatus through the communication interface device (not shown). The image forming apparatus 100 may include a module (e.g., a transceiver) supporting at least one of various wired or wireless communication methods for connection with or communication with the external apparatus. The controller 120 may control the communication interface device (not shown) to transmit the information collected by the image forming apparatus 100 to the printing service management server.

Figure 3:
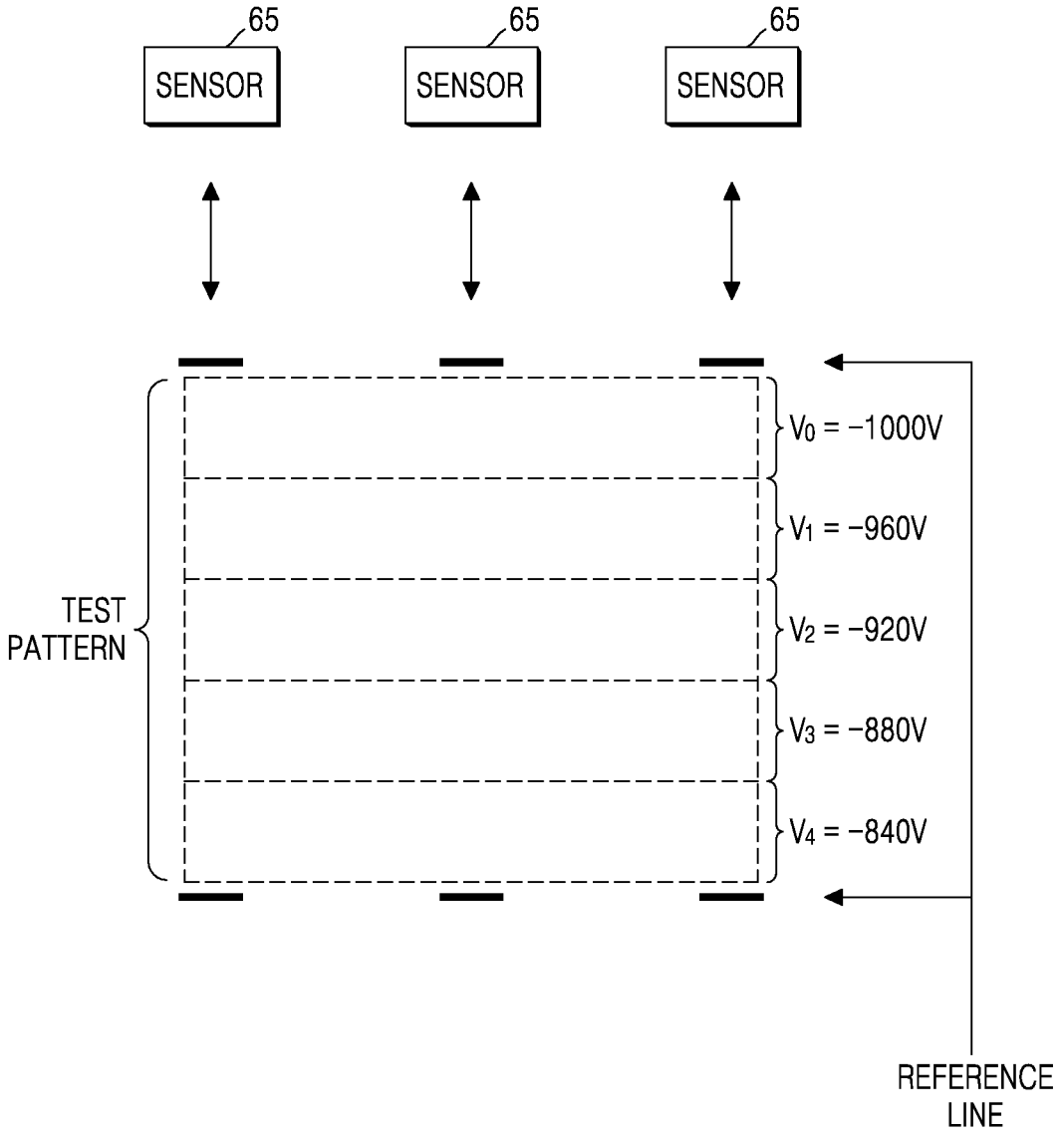
FIG. 3 illustrates a test pattern and a process of sensing an image corresponding to the test pattern according to an example.

FIG. 3 illustrates a test pattern and a process of sensing an image corresponding to the test pattern according to an example.

Referring to FIG. 3, an example test pattern may include a non-image area that is not exposed by the exposure device 50 after the photoconductor 14 is charged by the charger 15. In an example, the test pattern may be used for determining a remaining lifetime of the photoconductor 14. The test pattern may include a test area in which a developing process is performed without undergoing an exposure process under various charging conditions in which a background defect is more likely to occur than an actual printing condition. The test pattern may be obtained in a state in which the photoconductor 14 is charged only according to various charging voltages without being exposed, and may be regarded as a test area intentionally prepared to determine the remaining lifetime of the photoconductor 14. As shown in FIG. 3, an example test pattern may be divided into a plurality of area sections between a front end and a rear end of the test pattern. The test pattern may be used to determine whether the background defect occurs under various charging conditions in which the charging voltage is changed stepwise according to the area sections. In the example of FIG. 3, when a reference charging voltage set for a normal printing operation is −1000V, the charging voltage may be applied stepwise while changing by a voltage increase of 40V to generate the image corresponding to the test pattern. As such, charging voltages of different magnitudes may be in an equally increasing relationship from the reference charging voltage. As illustrated in the example of FIG. 3, the test pattern may be divided into 5 area sections and a respective charging voltage for each area section may be −1000V, −960V, −920V, −880V, and −840V. Of course, the present disclosure is not limited thereto. The number of the plurality of area sections constituting the test pattern may be arbitrarily adjusted, and the area sections may be equally or unequally spaced. Also, a magnitude of the increasing voltage corresponding to a difference between the charging voltages may be set to any value, and the value difference between the charging voltages may remain uniform or may be different.

In an example, whether the background defect occurs in the image corresponding to the test pattern may be related to an actual usage amount of the photoconductor 14. The difference between the developing voltage and the charging voltage may be reduced as the charging voltage increases and the usage amount of the photoconductor 14 increases, and thus, a probability that the background defects may occur in the image corresponding to the test pattern may increase. For example, when the usage amount of the photoconductor 14 is small, even though the charging voltage changes stepwise, the background defect may not occur under any charging condition. On the other hand, when the usage amount of the photoconductor 14 is large and a replacement time is near or has been reached, the background defect may occur even by increasing the charging voltage by one step.

Referring to FIG. 3, an example in which the sensor 65 senses a center portion of the image corresponding to the test pattern and both edge portions with respect to the center portion is shown. However, the present disclosure is not limited thereto. The sensor 65 may sense the image corresponding to the test pattern on the intermediate transfer medium 60, which is rotationally moved by the intermediate transfer roller 61. The image corresponding to the test pattern transferred onto the intermediate transfer medium 60 may be sensed by the sensor 65 positioned to face one side of the intermediate transfer medium 60 so as to correspond to the same line in a main scanning direction of the intermediate transfer medium 60 when the intermediate transfer medium 60 moves. As shown in FIG. 3, the sensor 65 may be a plurality of sensors corresponding to different portions of the photoconductor 14.

When the image corresponding to the test pattern moves to a position that the sensor 65 may sense, the sensor 65 may sense the image corresponding to the test pattern. Reference lines may be respectively formed near the front end and the rear end of the test pattern. For example, there may be reference lines before a start portion and after an end portion of the test pattern. That is, the test pattern may be located between two reference lines. The sensor 65 may detect the reference line located near the front end of the test pattern and the reference line located near the rear end of the test pattern and sense the image corresponding to the test pattern located between the two reference lines.

The sensor 65 may sense the image corresponding to the test pattern between the reference lines formed near the front end and the rear end of the test pattern and transmit the sensed image to the controller 120. The controller 120 may determine the remaining lifetime of the photoconductor 14 based on the image corresponding to the test pattern. In an example, the controller 120 may determine the remaining lifetime of the photoconductor 14 based on the image corresponding to the test pattern obtained over time.

Figure 4:
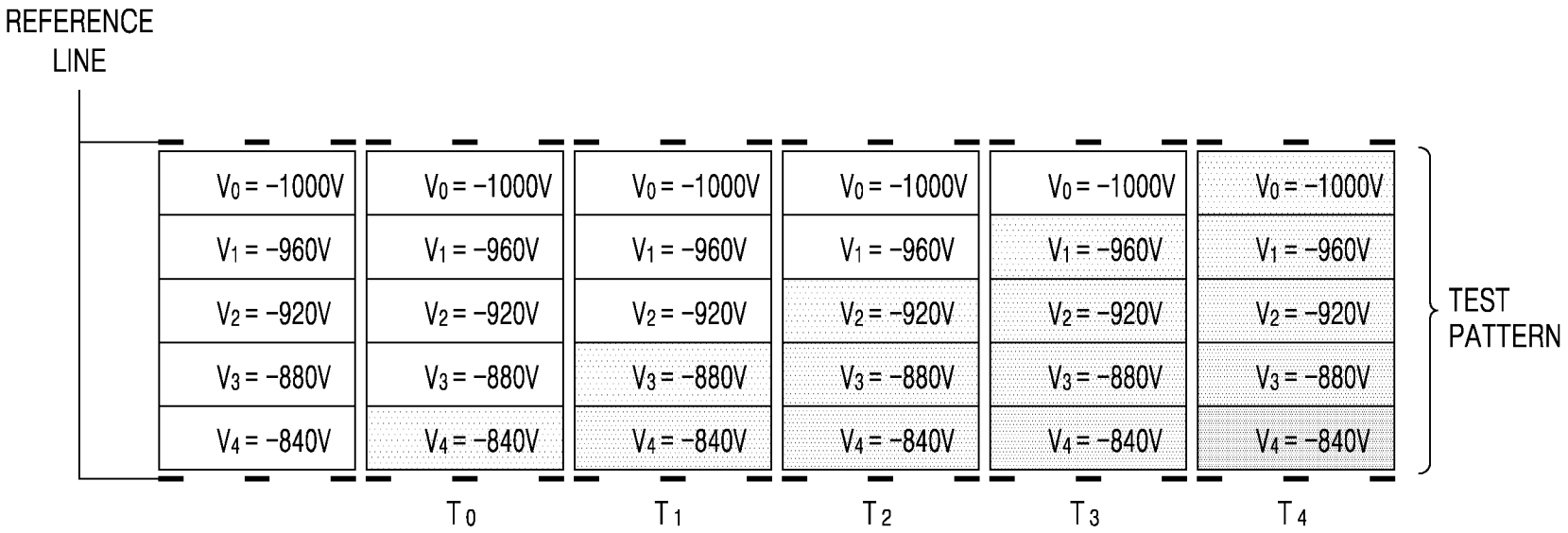
FIG. 4 is a diagram for explaining an image corresponding to a test pattern obtained over time according to an example.

FIG. 4 is a diagram for explaining an image corresponding to a test pattern obtained over time according to an example.

Referring to FIG. 4, an example result of outputting an image corresponding to a test pattern over time is shown. On the leftmost side of FIG. 4, when a usage amount of the photoconductor 14 is small, it may be seen that there is no area section in which a background defect occurs, regardless of a charging voltage. However, in the example of FIG. 4, it may be seen that as a usage amount of the photoconductor 14 increases, a thickness of a coating film decreases and area sections in which the background defect occurs increase over time. In FIG. 4, it may be seen that a reference charging voltage set for a normal printing operation is equal to −1000V. It may also be seen that the number of area sections in which the background defect occurs increases one by one in the image corresponding to the test pattern over time.

Referring to FIG. 4, it may be seen that the background defect occurs only in an area section corresponding to a charging voltage of −840V at $T_0$. It may be seen that the background defect occurs in an area section corresponding to a charging voltage of −880V for the first time and the background defect also occurs in an area section corresponding to a charging voltage of −840V at $T_1$. It may be seen that the background defect occurs in an area section corresponding to a charging voltage of −920V for the first time and the background defect also occurs in area sections corresponding to a charging voltage of −840V and −880V at $T_2$. It may be seen that, as the usage amount of the photoconductor 14 increases over time, the magnitude of the charging voltage at which the background defect occurs for the first time decreases and the background defect occurs in more area sections. It may also be seen that the background defects occur in all area sections corresponding to other charging voltages at $T_3$ except for the reference charging voltage $V_0$ of −1000V. Therefore, although the background defect does not occur during the normal printing operation up to $T_3$, because the background defect is likely to occur at the reference charging voltage $V_0$ of −1000V in the near future, it means that the background defect may occur even during the normal printing operation. It may be seen that the background defect occurs even at the reference charging voltage $V_0$ of −1000V at $T_4$, and the photoconductor 14 needs to be immediately replaced.

Figure 5:
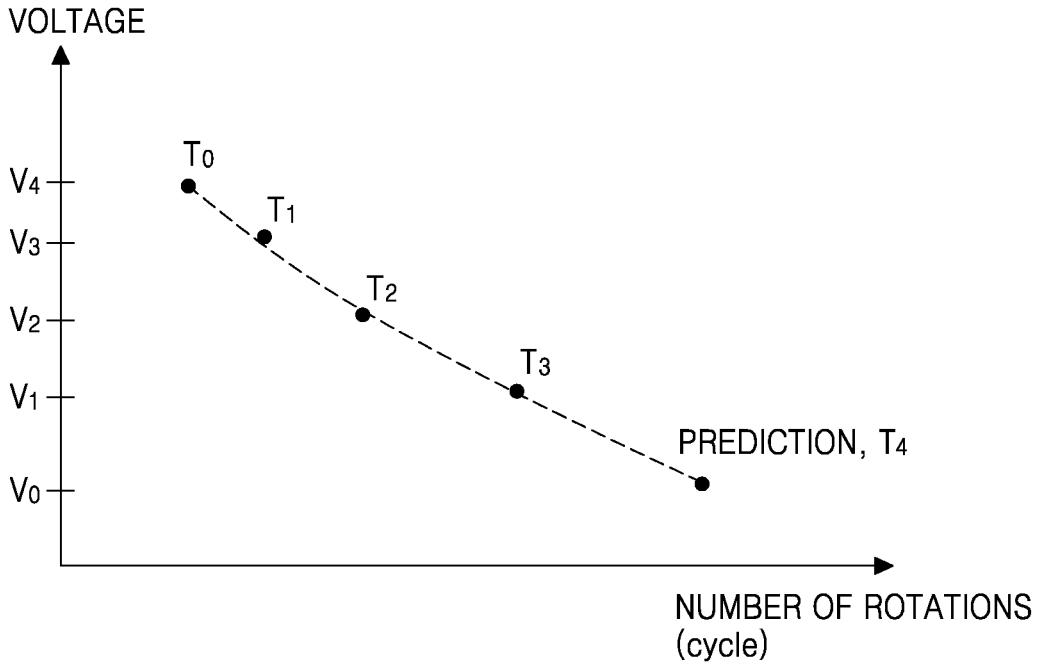
FIG. 5 illustrates an estimation of usage amount information of a photoconductor in which a background defect occurs when a reference charging voltage set for a normal printing operation is applied according to an example.

FIG. 5 illustrates an estimation of usage amount information of a photoconductor in which a background defect occurs when a reference charging voltage set for a normal printing operation is applied according to an example.

In an example as illustrated in FIG. 4 above, although the reference charging voltage set for the normal printing operation is equal to −1000V, a charging voltage value, the usage amount information of the photoconductor 14, and usage period information may be different from each other in an area section in which the background defect occurs in an image corresponding to a test pattern. Accordingly, the controller 120 may store the charging voltage value in the area section where the background defect occurs in the image corresponding to the test pattern, the reference charging voltage value set for the normal printing operation, the usage amount information of the photoconductor 14, and the usage period information over time in a memory (not shown).

Referring to FIG. 5, a relationship between the charging voltage and the usage amount information of the photoconductor 14 in the area section where the background defect occurs in the image corresponding to the test pattern over time is shown. The usage amount information of the photoconductor 14 may be information such as a number of rotations of the photoconductor 14 or a number of times of printing a printout. In the example of FIG. 5, the number of rotations of the photoconductor 14 is utilized as the usage amount information of the photoconductor 14. It may be seen that as time passes from $T_0$ to $T_3$, a charging voltage at which the background defect occurs is also lowered from $V_4$ to $V_1$, and is close to a value of the reference charging voltage $V_0$. Also, the usage amount information of the photoconductor 14 increases so that the number of rotations of the photoconductor 14 increases.

When the relationship between the charging voltage and the usage amount information of the photoconductor 14 in the area section where the background defect occurs is expressed as an equation, the usage amount information (i.e., $T_4$) of the photoconductor 14 in which the background defect occurs when the reference charging voltage $V_0$ is applied may be estimated. For example, when modeling a graph of FIG. 5 as a third order polynomial, coefficients of the polynomial may be derived based on a characteristic of the graph that monotonically decreases with the information stored in the memory (not shown). By using the equation indicating the relationship between the charging voltage and the usage amount information of the photoconductor 14 in the area section where the background defect occurs, the usage amount information (i.e., $T_4$) of the photoconductor 14 in which the background defect occurs when the reference charging voltage $V_0$ is applied may be estimated.

Figure 6:
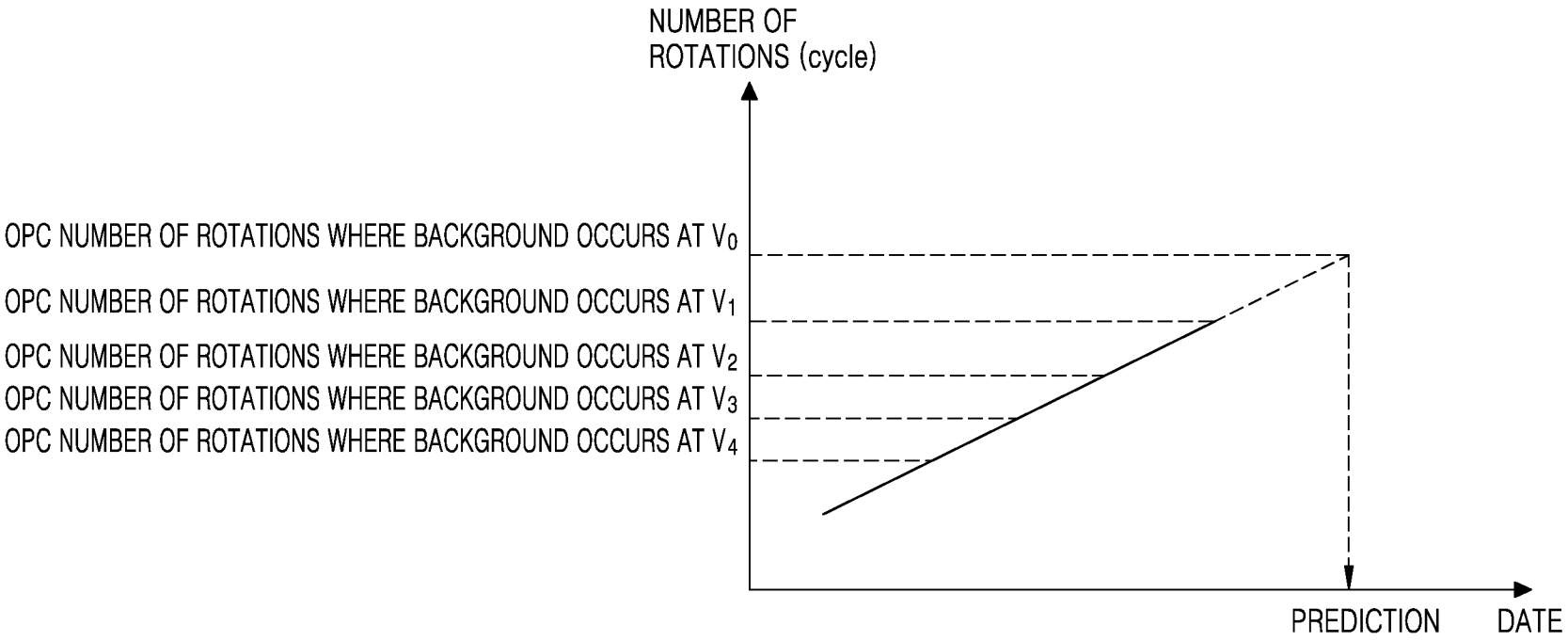
FIG. 6 illustrates a method of estimating a remaining lifetime of a photoconductor according to an example.

FIG. 6 illustrates a method of estimating a remaining lifetime of a photoconductor according to an example.

Referring to FIG. 6, an example relationship between usage amount information of the photoconductor 14 and usage period information at a charging voltage at which a background defect occurs over time is shown. The usage period information may be date information. In a manner similar to that in FIG. 5, when modeling a graph of FIG. 6 as a polynomial, coefficients of the polynomial may be derived based on a characteristic of the graph that monotonically increases with information stored in a memory (not shown).

When the relationship between the usage amount information of the photoconductor 14 and the usage period information at the charging voltage at which the background defect occurs is expressed as an equation, by using the usage amount information of the photoconductor 14 in which the background defect occurs when the reference charging voltage $V_0$ is applied, date information corresponding to a usage amount of the photoconductor 14 may be estimated. Accordingly, a remaining period from a current date to an estimated date may be determined as the remaining lifetime, or the estimated date may be predicted as a replacement time of the photoconductor 14.

FIG. 7 is a diagram showing charge voltages of different magnitudes applied to a photoconductor when a reference charging voltage changes over time according to an example.

Referring to FIG. 7, the reference charging voltage set for a normal printing operation may change according to an environment of an image forming apparatus in order to maintain an output density of a printout constant. In the example of FIG. 7, charging voltages of different magnitudes corresponding to a plurality of respective area sections constituting a test pattern when the reference charging voltage changes over time are shown. As illustrated in FIG. 7, it may be seen that the reference charging voltage, which was −1000V at $T_0$, continuously decreases by −100V over time, and changes to −1100V, −1200V, and −1300V. On the other hand, the charging voltages of different magnitudes corresponding to the plurality of respective area sections constituting the test pattern, that is, test charging voltages, may be in a relationship of increasing by 40V from a reference charging voltage of the corresponding time.

Figure 8:
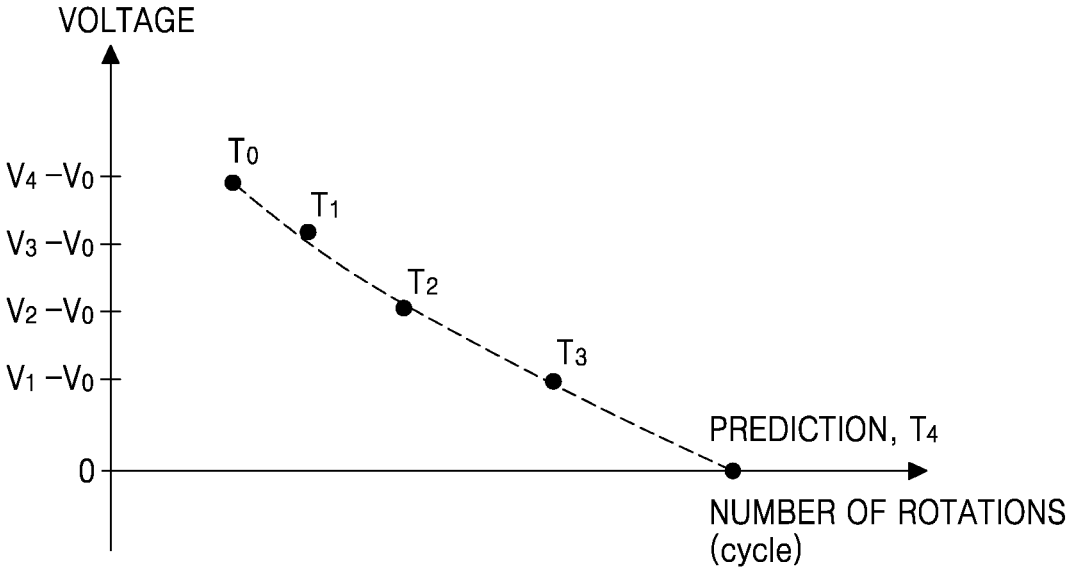
FIG. 8 illustrates an estimation of usage amount information of a photoconductor in which a background defect occurs when a reference charging voltage set for a normal printing operation is applied according to an example.

FIG. 8 illustrates an estimation of usage amount information of a photoconductor in which a background defect occurs when a reference charging voltage set for a normal printing operation is applied according to an example.

In an example as illustrated in FIG. 7 above, over time the reference charging voltage set for the normal printing operation changes, and a charging voltage, the usage amount information of the photoconductor 14, and usage period information may be different from each other in an area section where the background defect occurs in an image corresponding to a test pattern. In the example of FIG. 7, a charging voltage in the area section where the background defect occurs is −840V at $T_0$, a charging voltage in the area section where the background defect occurs is −980V at $T_1$, a charging voltage in the area section where the background defect occurs is −1120V at $T_2$, and a charging voltage in the area section where the background defect occurs is −1260V at $T_3$.

Referring to FIG. 8, a relationship between a difference between the charging voltage in the area section where the background defect occurs in the image corresponding to the test pattern and the reference charging voltage and the usage amount information of the photoconductor 14 over time is shown. In FIG. 8, the number of rotations of the photoconductor 14 is used as the usage amount information of the photoconductor 14. It may be seen that as time passes from $T_0$ to $T_3$, the difference between the charging voltage in the area section where the background defect occurs and the reference charging voltage is gradually lowered to 160V (i.e., −840V+1000V), 120V (i.e., −980V+1100V), 80V (i.e., −1120V+1200V), and 40V (i.e., −1260V+1300V), and a usage amount of the photoconductor 14 increases so that the number of rotations of the photoconductor 14 increases.

If the relationship between the difference between the charging voltage in the area section where the background defect occurs and the reference charging voltage and the usage amount information of the photoconductor 14 is expressed as an equation, when the difference between the charging voltage in the area section where the background defect occurs and the reference charging voltage is 0V, the usage amount information of the photoconductor 14 where the background defect occurs may be estimated. By using the equation indicating the relationship between the difference between the charging voltage in the area section where the background defect occurs and the reference charging voltage and the usage amount information of the photoconductor 14, when the reference charging voltage is applied, the usage amount information of the photoconductor 14 where the background defect occurs may be estimated. Also, as shown in FIG. 6, when a relationship between the usage amount information of the photoconductor 14 and usage period information at the charging voltage where the background defect occurs is expressed as an equation, by using the usage amount information of the photoconductor 14 where the background defect occurs, date information corresponding to a usage amount of the photoconductor 14 may be estimated. Accordingly, a remaining period from a current date to an estimated date may be estimated as the remaining lifetime, or the estimated date may be predicted as a replacement time of the photoconductor 14.

Figure 9:
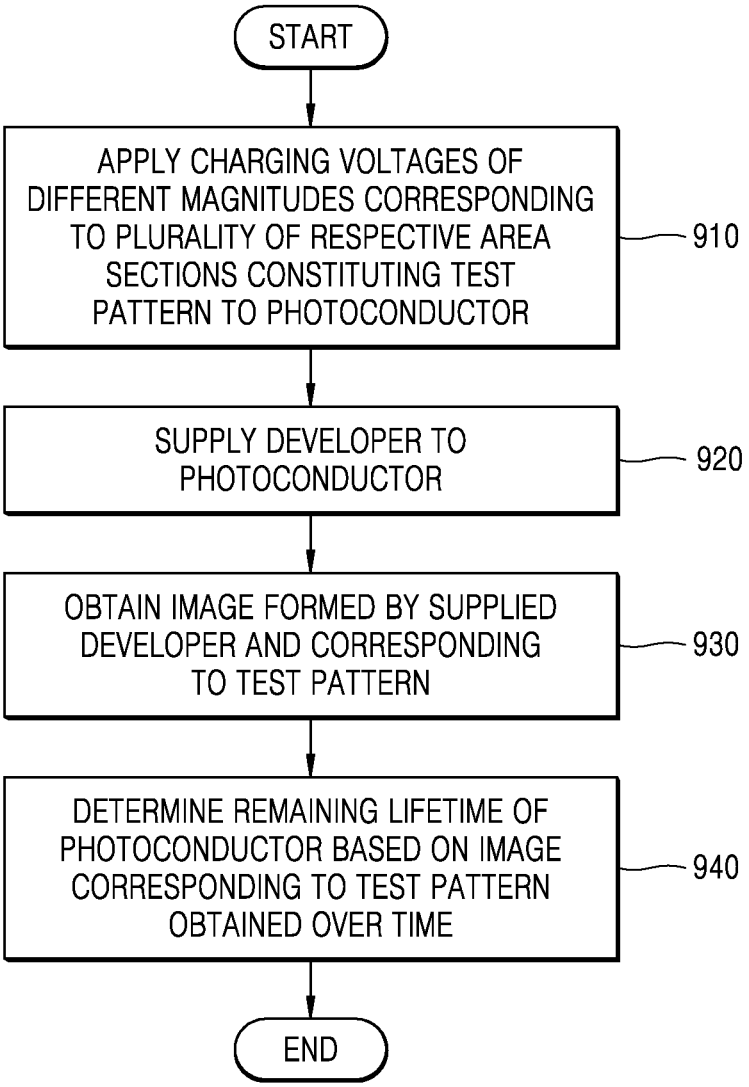
FIG. 9 is a flowchart of a method for determining a remaining lifetime of a photoconductor according to an example.

FIG. 9 is a flowchart of a method for determining a remaining lifetime of the photoconductor according to an example.

Referring to FIG. 9, the image forming apparatus 100 may apply charging voltages of different magnitudes to the photoconductor 14 corresponding to a plurality of respective area sections constituting a test pattern in operation 910. For example, the image forming apparatus 100 may apply the charging voltages of different magnitudes, to the photoconductor 14, that are in an equally increasing relationship from a reference charging voltage set for a normal printing operation. The image forming apparatus 100 may change and apply the charging voltage to the photoconductor 14 at a certain time interval or whenever the photoconductor 14 rotates by a predetermined angle.

In operation 920, the image forming apparatus 100 may supply a developer to the photoconductor 14. The image forming apparatus 100 may supply the developer to the photoconductor 14 without performing an exposure process.

In operation 930, the image forming apparatus 100 may obtain (e.g., sense) an image corresponding to the test pattern formed by the supplied developer. For example, the image forming apparatus 100 may obtain the image corresponding to the test pattern between reference lines formed near a front end and a rear end of the test pattern.

In operation 940, the image forming apparatus 100 may determine the remaining lifetime of the photoconductor 14 based on the image corresponding to the test pattern. In an example, the image forming apparatus 100 may determine the remaining lifetime of the photoconductor 14 based on the image corresponding to the test pattern obtained over time.

For example, the image forming apparatus 100 may store a value of a charging voltage in an area section where a background defect occurs in the image corresponding to the test pattern, a reference charging voltage value set for the normal printing operation, usage amount information of the photoconductor 14, and usage period information for every predetermined period. The image forming apparatus 100 may estimate the remaining lifetime of the photoconductor 14 according to a trend analysis based on the stored information.

As another example, the image forming apparatus 100 may transmit the value of the charging voltage in the area section where the background defect occurs in the image corresponding to the test pattern, the reference charging voltage value set for the normal printing operation, the usage amount information of the photoconductor 14, and the usage period information to a printing service management server for every predetermined period. The image forming apparatus 100 may receive the remaining lifetime of the photoconductor 14, from the printing service management server, estimated according to a trend analysis based on the transmitted information.

It should be understood that examples described herein should be considered in a descriptive sense only and not for purposes of limitation. Descriptions of features or aspects within each example should typically be considered as available for other similar features or aspects in other embodiments. While one or more examples have been described with reference to the figures, it will be understood by those of ordinary skill in the art that various changes in form and details may be made therein without departing from the spirit and scope as defined by the following claims.

The above-described method of determining a remaining lifetime of a photoconductor may be implemented by a non-transitory computer-readable storage medium storing instructions or data executable by a computer or a processor. The examples may be written as computer programs and may be implemented in general-use digital computers that execute the programs by using a computer-readable storage medium. Examples of the non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disk, solid-status disk (SSD), and instructions or software, associated data, data files, and data structures, and any device capable of providing instructions or software, associated data, data files, and data structures to a processor or a computer such that the processor or computer may execute instructions.

What is claimed is:

1. An image forming apparatus comprising:

a charger to apply a plurality of charging voltages to a photoconductor, the plurality of charging voltages having different magnitudes and respectively corresponding to a plurality of area sections;

a developing device to supply a developer to the photoconductor;

a sensor to sense a background defect formed by the supplied developer and corresponding to the area section, the background defect formed on one of the photoconductor or an intermediate transfer medium; and a controller to provide information for a remaining lifetime of the photoconductor or a replacement time based on the corresponding area section wherein the background defect is formed.

2. The image forming apparatus of claim 1, wherein the plurality of charging voltages of different magnitudes are in an equally increasing relationship from a reference charging voltage set for a normal printing operation.

3. The image forming apparatus of claim 1, wherein the plurality of charging voltages are applied to the photoconductor based on a certain time interval or based on a rotation of the photoconductor by a predetermined angle.

4. The image forming apparatus of claim 1, wherein the developing device is further to supply the developer to the photoconductor that does not perform an exposure process.

5. The image forming apparatus of claim 1, wherein the sensor is further to sense the background defect in the area sections between reference lines formed near a front end and a rear end.

6. The image forming apparatus of claim 1, further comprising:

a memory, wherein the controller is further to store a value of a charging voltage in an area section where a background defect occurs, a reference charging voltage value set for a normal printing operation, usage amount information of the photoconductor, and usage period information in the memory for every predetermined period and estimate the remaining lifetime of the photoconductor according to a trend analysis based on information stored in the memory.

7. The image forming apparatus of claim 1, further comprising:

a communication interface device, wherein the controller is further to transmit a value of a charging voltage in an area section where a background defect occurs, a reference charging voltage value set for a normal printing operation, usage amount information of the photoconductor, and usage period information to a printing service management server for every predetermined period through the communication interface device and receive the remaining lifetime of the photoconductor, from the printing service management server, estimated according to a trend analysis based on the transmitted information through the communication interface device.

8. The image forming apparatus of claim 1, further comprising:

a memory, wherein the controller is further to store a value of a charging voltage in an area section where a background defect occurs, a reference charging voltage value set for a normal printing operation, usage amount information of the photoconductor, and usage period information in the memory for every predetermined period and estimate the remaining lifetime of the photoconductor according to a trend analysis based on information stored in the memory.

9. A method of determining a remaining lifetime of a photoconductor, the method comprising:

applying a plurality of charging voltages to a photoconductor, the plurality of charging voltages having different magnitudes and respectively corresponding to a plurality of area sections;

supplying a developer to the photoconductor;

sensing a background defect formed by the supplied developer and corresponding to the area section, the background defect formed on one of the photoconductor or an intermediate transfer medium; and providing information for a remaining lifetime of the photoconductor or a replacement time based on the area section wherein the background defect is formed.

10. The method of claim 9, wherein the plurality of charging voltages of different magnitudes are in an equally increasing relationship from a reference charging voltage set for a normal printing operation.

11. The method of claim 9, wherein the plurality of charging voltages are applied to the photoconductor based on a certain time interval or based on a rotation of the photoconductor by a predetermined angle.

12. The method of claim 9, wherein the supplying of the developer comprises supplying the developer to the photoconductor that does not perform an exposure process.

13. The method of claim 9, wherein the sensing comprises sensing the background defect between reference lines formed near a front end and a rear end.

14. The method of claim 9, wherein the determining of the remaining lifetime of the photoconductor further comprises:

storing a value of a charging voltage in an area section where a background defect occurs, a reference charging voltage value set for a normal printing operation, usage amount information of the photoconductor, and usage period information for every predetermined period; and estimating the remaining lifetime of the photoconductor according to a trend analysis based on the stored information.

15. The method of claim 9, wherein the determining of the remaining lifetime of the photoconductor further comprises:

transmitting a value of a charging voltage in an area section where a background defect occurs, a reference charging voltage value set for a normal printing operation, usage amount information of the photoconductor, and usage period information to a printing service management server for every predetermined period; and receiving the remaining lifetime of the photoconductor, from the printing service management server, estimated according to a trend analysis based on the transmitted information.

16. An image forming apparatus comprising:

a charger to apply a plurality of charging voltages to a photoconductor, the plurality of charging voltages having different magnitudes and respectively corresponding to a plurality of area sections between a front end and a rear end of a test pattern;

a developing device to supply a developer to the photoconductor;

a sensor to sense a background defect formed by the supplied developer and corresponding to the area section; and a controller to provide information for a remaining lifetime of the photoconductor or a replacement time based on the corresponding area section wherein the background defect is formed.

17. The image forming apparatus of claim 16, wherein the plurality of charging voltages of different magnitudes are in an equally increasing relationship from a reference charging voltage set for a normal printing operation.

18. The image forming apparatus of claim 16, wherein the plurality of charging voltages are applied to the photoconductor based on a certain time interval or based on a rotation of the photoconductor by a predetermined angle.

19. The image forming apparatus of claim 16, wherein the developing device is further to supply the developer to the photoconductor that does not perform an exposure process.

20. The image forming apparatus of claim 16, wherein the sensor is further to sense the background defect formed on one of the photoconductor or an intermediate transfer medium.

* * * * *